US006574924B2

(12) United States Patent
Maniezzo

(10) Patent No.: US 6,574,924 B2
(45) Date of Patent: Jun. 10, 2003

(54) FITTING FOR WALLS OR PANELS

(75) Inventor: Dario Luigi Maniezzo, Vicenza (IT)

(73) Assignee: Lino Manfrotto & Co., S.p.A., Vicenza (IT)

( * ) Notice: Subject to any disclaimer, the term of this patent is extended or adjusted under 35 U.S.C. 154(b) by 94 days.

(21) Appl. No.: 09/730,831

(22) Filed: Dec. 7, 2000

(65) Prior Publication Data

US 2001/0002521 A1 Jun. 7, 2001

(51) Int. Cl.[7] ..... A47F 5/08; A47F 5/00

(52) U.S. Cl. ..... 52/36.4; 52/36.5; 52/704; 211/90.01; 248/220.31; 248/222.52; 248/224.51; 248/224.61; 403/348; 403/349

(58) Field of Search ..... 52/27, 36.4, 36.5, 52/36.6, 701, 704, 706, 708; 108/33, 42, 29; 211/90.01, 90.02, 87.01, 105.1; 248/220.21, 220.31, 221.11, 222.52, 223.41, 225.11, 56, 224.51, 224.61; 403/348, 349, 350, 351

(56) References Cited

U.S. PATENT DOCUMENTS

| | | | | | |
|---|---|---|---|---|---|
| 1,932,099 | A | * | 10/1933 | Cabana | 15/143.1 |
| 2,516,195 | A | * | 7/1950 | Finton | 285/402 |
| 2,601,088 | A | * | 6/1952 | Burgess | 116/173 |
| 2,859,840 | A | * | 11/1958 | Fantle | 211/182 |
| 3,042,161 | A | * | 7/1962 | Meyer, Jr. | 119/790 |
| 3,404,503 | A | * | 10/1968 | Courtois et al. | 116/DIG. 14 |
| 4,209,098 | A | | 6/1980 | Adams | |
| 4,223,862 | A | * | 9/1980 | Doughty | 211/105.1 |
| 4,739,885 | A | * | 4/1988 | Noland et al. | 206/493 |
| 5,961,082 | A | * | 10/1999 | Walter | 211/87.01 |
| 5,980,150 | A | * | 11/1999 | Newman et al. | 4/236 |
| 6,085,916 | A | * | 7/2000 | Kovacevic et al. | 211/86.01 |

FOREIGN PATENT DOCUMENTS

| | | | | |
|---|---|---|---|---|
| DE | 94 07 340 U | | 9/1994 | |
| DE | 198 51 268 C | | 8/1999 | |
| FR | 1141155 | * | 4/1957 | 403/349 |
| FR | 1496227 | * | 9/1967 | 403/349 |
| GB | 365401 A | * | 1/1932 | 52/36.5 |
| GB | 2 186 906 A | | 8/1987 | |

* cited by examiner

*Primary Examiner*—Carl D. Friedman
*Assistant Examiner*—Brian E. Glessner
(74) *Attorney, Agent, or Firm*—Sughrue Mion, PLLC

(57) ABSTRACT

A fitting for walls or panels includes a female coupling element which can be mounted on the panel or wall an a support element which can be fixed releasably in the female coupling element. A coupling and a complementary coupling are provided for restraining the support element in the female coupling element and include a pin and a catch seat, respectively, and a resilient member are also provided for urging the pin into the catch seat so as to prevent accidental disengagement of the coupling and the complementary coupling.

12 Claims, 3 Drawing Sheets

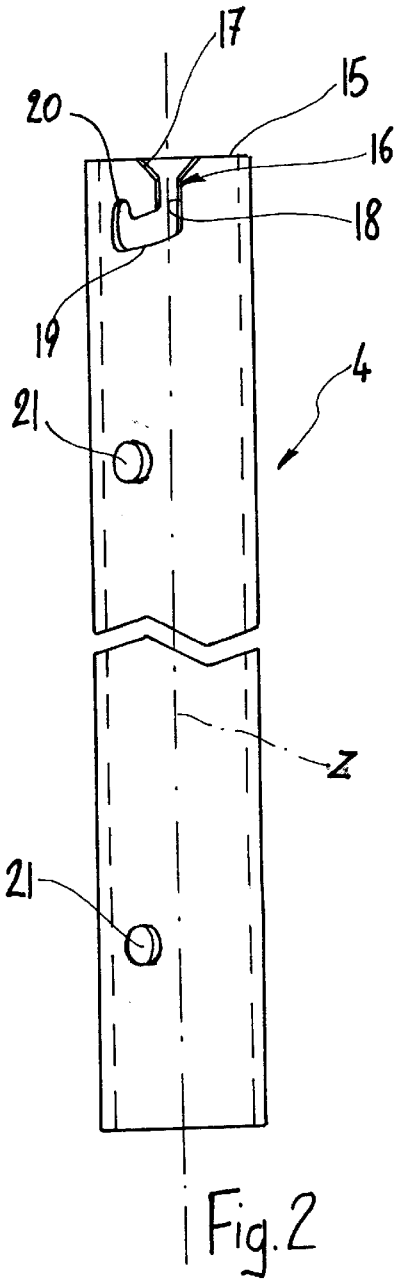
Fig.2
Fig.3
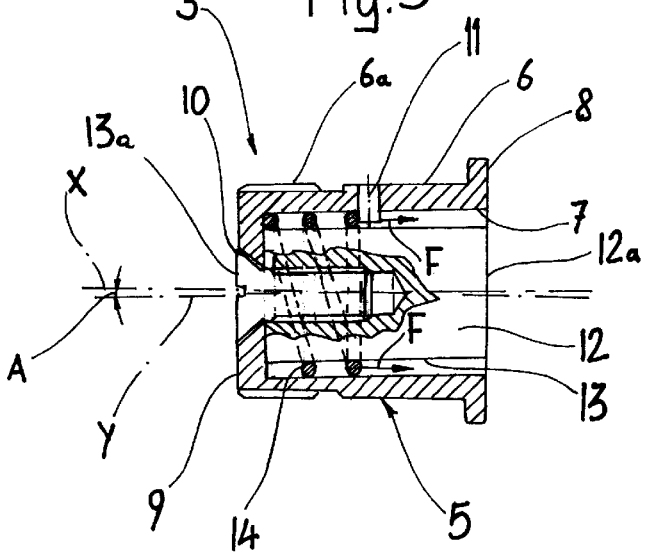
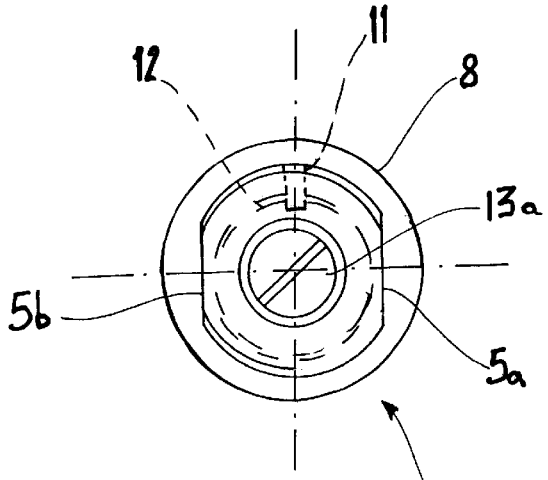
Fig.4

FITTING FOR WALLS OR PANELS

BACKGROUND OF THE INVENTION

The present invention relates to a fitting for walls or panels, according to the preamble to main Claim 1.

In the field of display structures, it is known to use modular panels equipped with fittings which comprise female coupling elements mounted firmly on the panels and support elements with male couplings which can be coupled releasably in the corresponding female elements for the suspension thereon of the items to be displayed or for the support of shelves or brackets on which the items are subsequently placed.

The support elements are restrained releasably in the female coupling elements by a releasable bayonet coupling.

However, these fittings have many disadvantages, amongst which is the fact that the support element may accidentally be disengaged, resulting in its detachment from the panel.

A further disadvantage is the displeasing aesthetic effect of the holes in the female coupling elements on the visible face of the panel.

SUMMARY OF THE INVENTION

The problem upon which the present invention is based is that of providing a fitting for panels or walls equipped with fittings, which is designed structurally and functionally to overcome the limitations described above with reference to the prior art mentioned.

This problem is solved by the invention by means of a fitting for walls or panels equipped with fittings, comprising a female coupling element which can be mounted on the panel or wall, a support element which can be fixed releasably in the female coupling element in a position such that the support element projects like a bracket from the panel or wall, as well as bayonet coupling means and complementary coupling means provided in one and in the other of the female coupling element and the support element, respectively, for restraining the support element in the female coupling element when the support element is fixed therein, wherein the coupling means and the complementary coupling means comprise, respectively, a pin and a catch seat for catching the pin, and in that resilient means are provided and act between the pin and the catch seat in order to urge the pin into the catch seat so as to prevent accidental disengagement of the coupling means and the complementary coupling means when the support element is fixed in the female coupling elements.

FIG. 2 is a plan view of a first detail of one of the fittings of FIG. 1, FIGS. 3 and 4 are a section through a second detail of one of the fittings of FIG. 1 and a rear elevational view thereof, respectively.

DETAILED DESCRIPTION OF THE INVENTION

Figure 1:
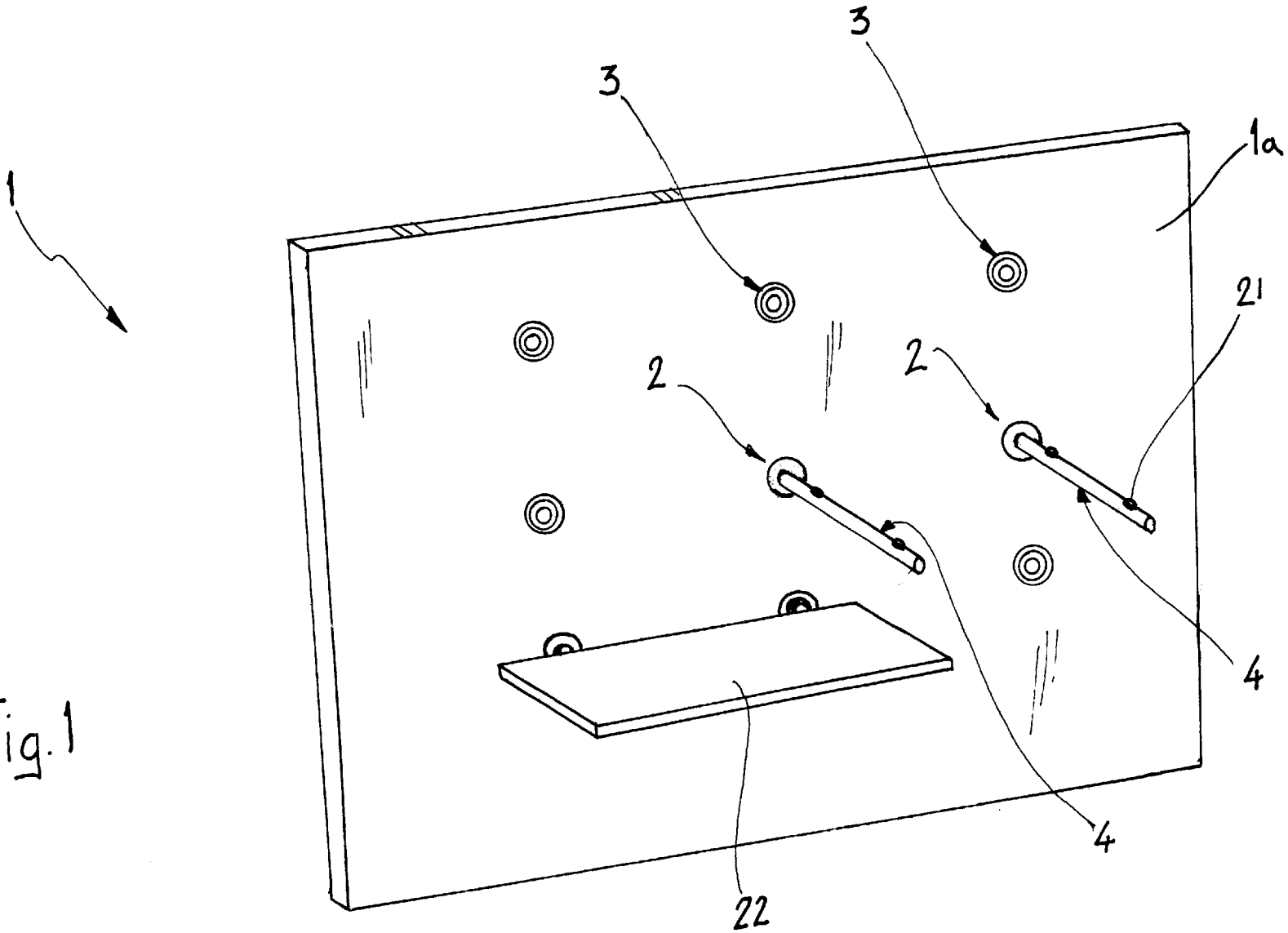
FIG. 1 is a perspective view of a panel equipped with fittings formed in accordance with the present invention.

In the drawings, a panel, indicated 1, is equipped with fittings 2 formed in accordance with the present invention.

Each fitting 2 comprises a female coupling element 3 which can be mounted on the panel 1 and a support element 4 which can be fixed releasably in the female coupling element 3.

Coupling means and complementary coupling means are provided on the female coupling element 3 and on the support element 4, respectively, for restraining the support element 4, by means of a bayonet coupling, in the female coupling element 3 when it is fixed therein.

The female coupling element 3 comprises a substantially cylindrical bush 5 with an outer curved surface 6 having an axis X and an inner curved surface 7 having an axis Y which is inclined at an angle A of between 0.5 and 5 degrees to the axis X.

The bush 5 has a screw thread on an end portion 6*a* of the outer surface 6 and, at its opposite end, has a flange 8 perpendicular to the axis X. The bush 5 is closed at its axial end remote from the flange 8 by a base 9 in which a flared hole 10 is formed.

Each female coupling element 3 is mounted on the panel 1 with the flange 8 in abutment with a visible face of the panel. At the opposite end, the female coupling element 3 is fixed to the panel 1 by means of a ring nut, not shown in the drawings, screwed onto the threaded portion 6*a*.

Two opposed flat areas 5*a*, 5*b* are formed axially in the outer surface 6 of the bush 5 and corresponding flat areas are provided in the hole for housing the female coupling element 3 in the panel 1. The flat areas 5*a*, 5*b* constitute locating means for the mounting of the female coupling element 3 in a predefined angular position on the panel 1.

A pin 11 is fixed in the bush 5 at a predetermined angular point relative to the flat areas 5*a*, 5*b* and a short portion of the pin 11 projects radially from the internal surface 7. A cylindrical core 12 having an axis Y is fixed inside the bush 5 and is restrained so as to be coaxial with the inner surface 7 by a screw 13*a* extending through the hole 10 in the base 9. An end 12*a* of the core 12 remote from the base 9 is flush with the flange 8.

An annular chamber 13 is defined between the inner surface 7 and the core 12.

Housed in the annular chamber 13 is a helical spring 14 which extends around the core 12 and is in abutment between the base 9 and the pin 11, a thrust axis and a thrust direction of the spring being indicated by the arrow F in FIG. 3.

The support element 4 comprises a cylindrical, preferably tubular, body with an axis Z. It has a substantially "J"-shaped slot, indicated 16, at one of its axial ends 15. Identified in the slot 16 are a flared mouth 17, a first portion 18 of predominant axial extent, a second, successive portion 19 extending transversely relative to the first portion 18 and preferably oriented away from the end 15, as well as a third successive, blind portion 20 which is elongate predominantly axially towards the end 15 and defines a catch seat, as will be explained further below.

Two or more appendages 21 suitable for supporting, for example, a bracket or a shelf 22, may be provided on the outer surface of the support element 4.

The angular positioning of the appendages is predetermined relative to that of the catch seat 20 for the reasons explained below.

The coupling means of the above-mentioned bayonet coupling comprise the pin 11 in the female coupling element 3 and the complementary coupling means comprise the slot 16. Naturally, the above-mentioned positioning may be reversed, in wholly equivalent manner, with the pin 11 on the support element 4 and the slot in the female coupling element.

Figure 5:
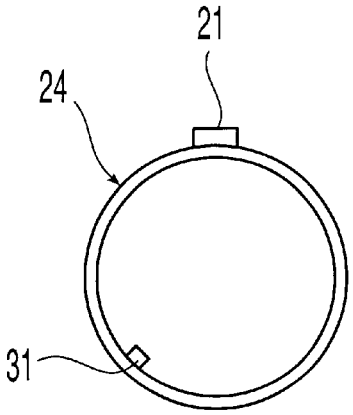
FIG. 5 is an end view of a support element according to a further embodiment.
Figure 6:
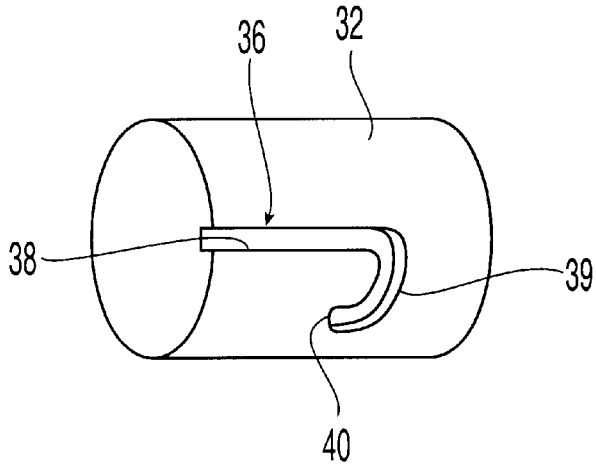
FIG. 6 is a perspective view of the core of the female coupling element according to the further embodiment.
Figure 7:
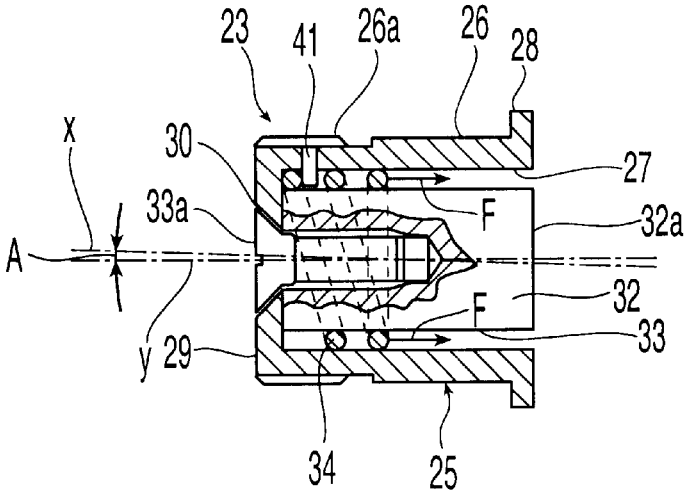
FIG. 7 is a cross-sectional view of the female coupling element according to the further embodiment.

In the embodiment according to FIGS. 5, 6 and 7 and a pin 31 is located on the inner surface of the support member for engagement with a slot 36 formed on the outer surface of the core 32 of the female coupling element 23.

As shown in FIG. 6 the slot 36 is provided with a first straight axially directed portion 38 and a second portion 39 which is curved and terminates in a catch seat 40.

As shown in FIG. 7 the female coupling element 23 is comprised of a substantially cylindrical bush 25 having an outer curved surface 26 having an axis X and an inner curved surface 27 having an axis Y which is inclined at an angle A of between 0.5 and 5° to the axis X. The bush 25 has a screw thread on an end portion 26*a* of the outer surface 26 and at its opposite end has a flange 28 perpendicular to the axis X. The bush 25 is closed at its axial end remote from the flange 28 by a base 29 in which a flared hole 30 is formed. The female coupling element 23 is fixed to the panel 1 by means of the ring nut similar to the first embodiment.

A cylindrical core 32 having an axis Y is fixed inside the bush 25 and is restrained so as to be coaxial with the inner surface 27 by a screw 33*a* extending through the hole 10 in the base 9. An end 32*a* if the core 32 remote from the base 29 is flush with the flange 28. An annular chamber 33 as defined between the inner surface 27 and the core 32.

Housed in the annular chamber 33 is a helical spring 34 which extends around the core 32 and is maintained in abutment with the base 29 by means of a pin 41 extending through the cylindrical bush 25.

When the support element 24 is inserted in the female coupling element 23 the complementary coupling means are housed in the annular chamber 33. As in the previous embodiment the first and second portions 38 and 39 of the slot 36 are engaged in succession by the pin 31 by means of a first, substantially axial movement in the opposite direction to the direction of thrust F of the spring 34 and a second rotary movement about the axis Z of the support element 24.

When the support element 24 is released a pin 31 will be caught in the catch seat 40 because of the thrust of the spring 34 which is compressed during the previous rotational-translational movement.

When the support element 4 is inserted in the female coupling element 3, the complementary coupling means are housed in the annular chamber 13. At this stage of the engagement of the bayonet coupling, the first and second portions 18 and 19 of the slot 16 are engaged in succession by the pin 11 by means of a first, substantially axial movement in the opposite direction to the direction of thrust F of the spring 14 and a second, rotary movement about the axis Z of the support element 4.

When the support element 4 is released, the pin 11 is caught in the catch seat 20 because of the thrust of the spring 14 which is compressed during the previous rotational-translational movement.

In this condition, any accidental disengagement is prevented since, in order to disengage the bayonet coupling, it is necessary first of all to press the support element 4 against the female coupling element 3 in opposition to the spring 14 and thus to release the support element and the female coupling element for relative rotation. The coupling is further strengthened by the core 12.

The relative arrangement of the inclination of the axis Y and of the locating means defined by the flat areas 5*a*, 5*b* is selected in a manner such that the axis Y is inclined upwardly. It is thus possible to compensate for any bending of the support element 4 under load and also as a result of the taking up of the play between the coupling elements.

Moreover, the coupling means and the complementary coupling means are positioned relative to one another in a manner such that the appendages 21 advantageously extend upwards in order to support any bracket or shelf correctly when the support element is fixed.

The present invention thus solves the problem complained of above with reference to the prior art mentioned, at the same time offering many further advantages, amongst which is a greater load capacity of the support elements and improved security against their accidental disengagement.

Moreover, the core of the female coupling element masks its cavity, considerably improving the appearance of the visible face of a panel thus equipped if respective support elements are not fitted in all of the female coupling elements.

What is claimed is:

1. A fitting for walls or panels equipped with fittings, comprising a female coupling element which can be mounted on the panel or wall, a support element which can be fixed releasably in the female coupling element in a position such that the support element projects like a bracket from the panel or wall, as well as bayonet coupling means and complementary coupling means provided in one and in the other of the female coupling element and the support element, respectively, for restraining the support element in the female coupling element when the support element is fixed therein, wherein the coupling means and the complementary coupling means comprise, respectively, a pin and a catch seat for catching the pin, and in that resilient means are provided and act between the pin and the catch seat in order to urge the pin into the catch seat so as to prevent accidental disengagement of the coupling means and the complementary coupling means when the support element is fixed in the female coupling element, and wherein the coupling means in the female coupling element comprise an annular cavity extending coaxially around a core and the complementary coupling means have a tubular shape in order to fit onto the core when the complementary coupling means are housed in the annular cavity.

2. A fitting according to claim 1 in which the resilient means have a thrust axis and a thrust direction, the complementary coupling means comprising a slot which can engage the pin by sliding and which includes a first portion extending with a predominant component parallel to the thrust axis and in the thrust direction, and a second portion extending substantially transverse the thrust axis, the catch seat extending as a continuation of the second portion of the slot with a predominant component extending parallel to the thrust axis and in the opposite direction to the thrust direction.

3. A fitting according to claim 2 in which the slot and the catch seat are generally "J"-shaped.

4. A fitting according to claim 1 in which the female coupling element has, at one of its ends, a flange which abuts the panel, and the core comprises an end extending substantially flush with the flange.

5. A fitting according to claim 1 in which the pin extends radially into the annular activity.

6. A fitting according to claim 1 in which the resilient means comprise a helical spring extending around the core and in abutment between a base of the annular cavity and the pin.

7. A fitting according to claim 1 in which a mounting axis substantially perpendicular to a surface of the panel or wall is identified in the female coupling element and the annular cavity has an axis which is inclined to the mounting axis.

8. A fitting according to claim 7 in which the axis of the annular cavity is inclined at an angle of between 0.5 degrees and 5 degrees to the mounting axis.

9. A fitting according to claim 1 in which locating means are provided on the female coupling element for the mounting of the female coupling element in a predetermined angular position o the panel or wall.

10. A panel or wall equipped with fittings comprising at least one female coupling element mounted on the panel or wall and respective support elements which can be fixed releasably in the at least one female coupling element, the at least one female coupling element and the respective support elements being formed in accordance with claim 1.

11. A panel or wall according to claim 10 comprising at least one visible face on which the annular cavity and the core of the at least one female coupling element are visible.

12. A display system comprising a panel or wall equipped with fittings for supporting a display, each fitting comprising a female coupling which can be mounted on the panel or wall, a support element which can be fixed releasably in the female coupling element in a position such that the support element projects like a bracket from the wall or panel, as well as bayonet coupling means and complementary coupling means provided in one and in the other of the female coupling element and the support element, respectively, for restraining the support element in the female coupling element when the support element is fixed therein, wherein the coupling means and the complementary coupling means comprise, respectively, a pin and a catch seat for catching the pin, and in that resilient means are provided and act between the pin and the catch seat in order to urge the pin into the catch seat so as to prevent accidental displacement of the coupling means and the complementary coupling means when the support element is fixed in the female coupling element, wherein each support element is provided with at least two appendages disposed along a longitudinally extending surface of said support element, wherein locating means are provided on the female coupling element for the mounting of the female coupling element in a predetermined angular position on the panel or wall, and wherein said appendages, said locating means, said pin and said catch are located relative to each other to position said appendages in an upwardly facing position for supporting the display.

* * * * *